US007004266B2

(12) United States Patent
Russell et al.

(10) Patent No.: US 7,004,266 B2
(45) Date of Patent: Feb. 28, 2006

(54) ADJUSTABLE DOWNHOLE TOOL

(76) Inventors: Mark Alexander Russell, Thorn House Low Bradfield, Sheffield, South Yorks (GB) S66LB; Andrew Ollerenshaw, 13 Dunkerley Road, Sheffield, South Yorkshire (GB) S6 6RB ( * ) Notice: Subject to any disclaimer, the term of this patent is extended or adjusted under 35 U.S.C. 154(b) by 60 days.

(21) Appl. No.: 10/775,949

(22) Filed: Feb. 10, 2004

(65) Prior Publication Data

US 2004/0168832 A1 Sep. 2, 2004

Related U.S. Application Data

(63) Continuation-in-part of application No. 09/914,912, filed on Nov. 21, 2001, now Pat. No. 6,708,785.

(30) Foreign Application Priority Data

Mar. 5, 1999 (GB) ..... 9905050
Mar. 6, 2000 (WO) ..... PCT/GB00/00775

(51) Int. Cl.
*E21B 7/06* (2006.01)

(52) U.S. Cl. ..... 175/321; 175/325.5; 166/240

(58) Field of Classification Search ..... 175/321, 175/325.5, 73, 76, 323; 156/240
See application file for complete search history.

(56) References Cited

U.S. PATENT DOCUMENTS

| | | | |
|---|---|---|---|
| 4,821,817 A | 4/1989 | Cendre et al. | |
| 5,483,987 A | 1/1996 | Amaudric du Chaffaut | |
| 5,794,694 A | 8/1998 | Smith, Jr. | |
| 6,708,785 B1 * | 3/2004 | Russell et al. | 175/321 |

FOREIGN PATENT DOCUMENTS

| | | |
|---|---|---|
| EP | A-0191529 | 8/1986 |
| EP | A-0251543 | 1/1988 |
| EP | A-0661412 | 7/1995 |
| GB | A-2251444 | 7/1992 |
| GB | A-2263923 | 8/1993 |
| GB | A-2314868 | 1/1998 |
| GB | A-2369136 | 5/2002 |

* cited by examiner

*Primary Examiner*—William Neuder
(74) *Attorney, Agent, or Firm*—Keeling Patents & Trademarks; Kenneth A. Keeling

(57) ABSTRACT

An adjustable down-hole tool, for example a drill-string stabiliser (10), comprises a body (12) having a through bore (16). A mandrel (18) is rotationally fixed but axially movable in the body, the mandrel being movable by fluid pressure in the tool against the action of a first return spring (44) between a first, activated position and a second deactivated position. A sleeve (66) is between shoulders (68, 69) on the body and mandrel. Castellations (18*a,b*, 69*a,b*) are on the mandrel and facing edge or edges of the sleeve so that, when the castellations are in phase the mandrel is prevented from travelling from said first to second position and when they are out of phase they interdigitate and the mandrel is not prevented from travelling from said first to second position. A control piston (36) is slidable in the mandrel, being movable by fluid pressure in the tool against the action of a second return spring (50). The piston is axially slidable with respect to said sleeve and rotationally fixed with respect thereto. A circumferential barrel cam (56) is defined on the piston, a cam follower (58) being disposed in the mandrel but within the confines of the barrel cam so that axial movement of the piston with respect to the mandrel results in corresponding rotation of the piston with respect to the mandrel.

22 Claims, 14 Drawing Sheets

14
68
48
66
V
33
52
36
50
20
54
22
56
58
46
38
28
10
30
24
31
26
42
27
23'
23
18
16
44
B
IV
IV
25
12
34
32
14
37
36
19
110
36
II
II
24
100
10
10
12

ADJUSTABLE DOWNHOLE TOOL

CROSS-REFERENCE TO RELATED APPLICATIONS

This application is a continuation-in-part application of Ser. No. 09/914,912 filed Nov. 21, 2001 now U.S. Pat. No. 6,708,785.

STATEMENT REGARDING FEDERALLY SPONSORED RESEARCH OR DEVELOPMENT

Not Applicable.

BACKGROUND OF THE INVENTION

This invention relates to adjustable down-hole tools employed in the oil and gas drilling industry.

Drill string stabilisers, under reamers and fishing tools are some of the down hole tools that require activation when they are in a given position down hole to make them operative, and deactivation when they are to be withdrawn, or repositioned or indeed simply to go into a different operating condition.

Taking stabilisers as an example, these tools centralise drill strings with respect to the hole drilled. They normally comprise a sub assembly in the drill string. The stabiliser has a plurality of blades, (usually three and usually spirally arranged), whose edges are adapted to bear against the bore-hole. The blades are not complete around a circumference of the drill string so that the return route for drilling mud pumped down the bore of the drill string is not blocked. In order to control the direction of drill bits, it is sometimes required that the stabiliser has variable diameter. Pistons in the blades are extendable to give the stabiliser a maximum diameter, which ensures that the drill string is central in the bore-hole. The drill bit, assuming the stabiliser is close behind the drill bit, is thus kept straight. However, if the pistons are withdrawn, then gravity can deflect the drill string so that it alters the inclination of the hole.

EP-A-0251543 describes a stabiliser that is activated by weight on the stabiliser from the drill string above it. Weight, or absence thereof, switches the stabiliser between activated and de-activated positions. The weight acts on a mandrel slidable in the bore of the stabiliser, which mandrel has ramps against which wedge-surfaces on the bases of the pistons slide. A mechanical detent is overcome by a compressive force on the stabiliser greater than a threshold value, so that unless substantial changes in weight act on the stabiliser, switching does not occur. This means that some variation in weight is permissable without changing the activation of the stabiliser. However, it is known that excessive changes in weight can occur unintentionally, possibly resulting in accidental activation and deactivation of the stabiliser.

It has been suggested to employ a rise in mud pump pressure to move the mandrel in the stabiliser. Changes in pressure switch the mandrel between different positions. Such a system is described in EP-A-0190529, in which a differential piston cooperates with a flow restrictor so that, if the fluid pressure rises beyond a low threshold, the piston (or flow restrictor) moves to rapidly and substantially increase the pressure differential across the piston which then drives the mandrel to activate the stabiliser. As a subsidiary feature the mandrel rotates on each stroke because the pads have pins which follow a barrel cam defined around the mandrel, which barrel cam has different steepness ramps so that the pads are extended different amounts. Unintentional variations in fluid pressure might also cause premature activation or deactivation.

GB-A-2263923 discloses a stabiliser control arrangement in which the object is to not be dependent on either fluid pressure or weight on the bit to maintain a stabiliser setting. This is achieved by lifting the drill string to positively disengage the locking mechanism, and then fluid pressure is employed to determine the stabiliser piston position. At the appropriate pressure the drill string is lowered to engage a lock, whereupon subsequent changes in fluid pressure have no effect on stabiliser position.

GB-A-2251444 has essentially the same aims as GB-A-2263923, except that, here, check valves prevent operation or deactivation of the stabiliser pads unless the pressure of the pump fluid exceeds or falls below upper and lower threshold values.

EP-A-0661412 has an arrangement similar to EP-A-0190529. The position of a control piston determines the pressure drop across the mandrel which therefore controls the position of the mandrel. The control piston has a barrel cam in which a pin of the housing slides, so that the piston is constrained to follow a course determined by the track. A junction in the track is provided so that, at an intermediate pressure, if the pressure is reversed the pin does not return to its starting point but goes up a branch to a lesser (or greater) extent than its starting point. The stabiliser is activated between upper and lower pressures and that the pressure be taken from one level to an intermediate level whereupon the direction of pressure change is reversed.

GB-A-2314868 describes an arrangement in which the mandrel is hydraulically operated between operative and inoperative positions. A first shoulder on the body of the stabiliser in which the mandrel slides has a serrated face. A facing shoulder on the body has a clutch face which is also serrated. Between the two faces is a sleeve which is axially fixed but rotationally freely slidable on the mandrel. On the edge of the sleeve facing the serrated edge of the body is series of knobs to engage the serrations and rotate the sleeve through a small angle when the sleeve is axially pressed against the serrations. On its other edge, it has a series of fingers to engage the clutch face and either catch on ridges of the clutch face, which are provided with stops to prevent further rotation of the sleeve, or they miss the stops and hit a sloping serration of the lower shoulder causing further rotation of the sleeve until its fingers coincide with long slots in the shoulder whereupon the sleeve permits the mandrel to go to its operative position.

Consequently, as pressure is alternated and the mandrel moves back and forth, when it first moves down, for example, it may rest on the ridges of the clutch face and prevent the mandrel from going to its operative position. When the pressure is released and the mandrel rises the knobs on the sleeve hit the serrations and turn the sleeve through a small angle; enough so that on the next stroke of the mandrel the fingers on the sleeve do not stay on the ridges. Instead, the fingers slide down the serrations of the clutch face and drop into slots therein. This movement takes the mandrel into its operative position. Finally on the return stroke, when the knobs again contact the serrated face the sleeve again rotates, repeating the cycle.

A problem with this arrangement, and with EP-A-0661412 is that the pressure which activates the stabiliser must be greater, of course, than the return force provided by springs, for example, which springs must themselves be very substantial in order to guarantee deactivation and overcome any jamming tendency which could occur through external pressure on the pistons. Consequently, there is wear on the components which are rotating, or causing the rotation, since they are simultaneously subject to substantial axial loads. Moreover, in the case of GB-A-2314868, because the fingers are the same components which result in rotation of the sleeve, they cannot be as substantial as their loading, particularly in an extended position, would ideally want them to be. Thus they may break.

GB-A-2314868 also discloses application of the mechanism described therein in relation to under reamers.

BRIEF SUMMARY OF THE INVENTION

It is therefore an object of the present invention to provide a down-hole tool activation arrangement which does not suffer from, or at least mitigates these or other problems.

In accordance with the present invention, there is therefore provided an adjustable down-hole tool comprising: a body having a through bore; mandrel axially movable and rotationally fixed in the body, the mandrel being movable by fluid pressure in the tool against the action of a first return spring between a first, deactivated position and a second activated position; a sleeve, said sleeve limiting movement of said mandrel between said positions; at least two sets of castellations, one set on the sleeve and the other set on an edge of the mandrel or body facing the castellations on the sleeve so that, when the castellations are in phase, the mandrel is prevented from travelling from said first to second position and when they are out of phase they interdigitate and the mandrel is not prevented from travelling from said first to second position; and means to rotate the sleeve relative to the facing edge between said in-phase and out-of-phase positions; wherein said means comprises a control piston slidable relative to the mandrel and the body by fluid pressure in the tool against the action of a second return spring and in which said piston is axially slidable with respect to said sleeve and rotationally coupled therewith.

In another respect, the present invention provides an adjustable down-hole tool comprising: a body having a through bore; a mandrel axially movable in the body, the mandrel being movable by fluid pressure in the tool against the action of a first return spring between a first, deactivated position and a second activated position; a shoulder on the body; a sleeve, said sleeve between the shoulder and the mandrel; at least two sets of castellations, one set on one of said shoulder and mandrel and the other set on a facing edge or edges of the sleeve so that, when the castellations are in phase, the mandrel is prevented from travelling from said first to second position and when they are out of phase they interdigitate and the mandrel is not prevented from travelling from said first to second position; and means to rotate the sleeve relative to the mandrel between said in-phase and out-of-phase positions; wherein said means comprises a control piston slidable with respect to the mandrel and the body by fluid pressure in the tool against the action of a second return spring; and wherein one of said piston and mandrel is rotationally fixed with respect to the body.

In another respect, the present invention provides an adjustable down-hole tool comprising: a body having a through bore; a mandrel axially movable in the body, the mandrel being movable by fluid pressure in the tool against the action of a first return spring between a first, activated position and a second deactivated position; a sleeve between a shoulder on the body and the mandrel; at least two sets of castellations, one on one of said shoulder and said mandrel and the other on a facing edge of the sleeve so that, when the castellations are in phase the mandrel is prevented from travelling from said first to second position and when they are out of phase they interdigitate and the mandrel is not prevented from travelling from said first to second position; and means to rotate the sleeve relative to the mandrel between said in-phase and out-of-phase positions; wherein said means comprises a control piston slidable in the mandrel, being movable by fluid pressure in the tool against the action of a second return spring; and wherein one of said piston and mandrel is rotationally fixed with respect to the body.

Preferably, it is said mandrel which is rotationally fixed with respect to the body. Preferably, said control piston is axially slidable with respect to said sleeve and rotationally fixed with respect thereto.

In yet another respect, a preferred adjustable down-hole tool in accordance with the invention comprises: a body having a through bore; a mandrel having a through bore axially movable in the body, the mandrel being movable by fluid pressure in the tool against the action of a first return spring between a first, deactivated position and a second activated position; a sleeve between the body and mandrel limiting movement of said mandrel between said positions; at least two sets of castellations, one set on the sleeve and the other set on a facing edge of the body or mandrel so that, when the castellations are in phase, the mandrel is prevented from travelling from said first to second position and, when they are out of phase, they interdigitate and the mandrel is not prevented from travelling from said first to second position; and a control piston to rotate the sleeve relative to said facing edge between said in-phase and out-of-phase positions, the piston being movable by fluid pressure in the tool against the action of a second return spring; wherein said control piston is slidable in the mandrel, the mandrel carrying rotation transmitters that are in contact with both the piston and sleeve, whereby rotation of the piston relative to the mandrel rotates the sleeve relative to the mandrel.

Preferably, said rotation transmitters are carried by the mandrel intermediate its ends. The rotation transmitters may be between axially spaced seals of the piston against the bore of the mandrel. Said rotation transmitters may comprise a gear rotationally journalled in the mandrel about an axis parallel the throughbores, both the piston and sleeve having a rack engaged with the gear. Preferably, a plurality of said gears are disposed around the circumference of the mandrel.

Preferably, a circumferential barrel cam is defined in one of said piston and mandrel, a cam follower being disposed in the other thereof, the follower being within the barrel cam so that axial movement of the piston with respect to the mandrel results in corresponding rotation of the piston with respect to the mandrel. In this case, the barrel cam may be shaped so that movement of the piston in one axial stroke and return thereof results in rotation of the sleeve from a said in-phase position to a said out-of-phase position or vice versa. Said castellations are preferably angularly spaced by a phase angle and said stroke and return of the piston results in rotation of the sleeve by said phase angle. The barrel cam, or follower, may be mounted on a separate component rotatably freely mounted, but axially fixed, on the piston, said component serving to rotate said sleeve.

When said mandrel is in said deactivated position, a rise in hydraulic pressure in the tool preferably results in movement of the piston before movement of the mandrel. Said first return spring may be sufficiently stronger than said second return spring to ensure that, when said mandrel is in said deactivated position, a rise in hydraulic pressure in the tool results in movement of the piston before movement of the mandrel. Alternatively, or in addition, a spring loaded detent may be provided between said mandrel and body to retain the mandrel in said deactivated position until a threshold hydraulic pressure has been exceeded, which pressure is greater than that required to move said piston. Said detent may comprise a plunger in a radial bore of the mandrel or body, spring biassed against a lip of the body or mandrel, respectively. Said lip may be of a circumferential groove around the mandrel.

Preferably, there are a plurality of said detents arranged around the circumference of the mandrel. This reduces any moment on the mandrel relative to the body.

The mandrel will usually have a through bore and be sealed to the body about first and second circumferences, the first being a larger circumference upstream, in terms of fluid flow through the tool, of the second, smaller circumference. Thus hydraulic forces act on the mandrel relative to the body urging the mandrel in a downstream direction. References to upstream and downstream are purely for convenience, of course. The direction of movement of the components in question is dependent only on hydraulic pressure, not on direction of flow.

The piston preferably also has a through bore and is sealed to the mandrel about third and fourth circumferences, the third being a larger circumference upstream, in terms of fluid flow through the tool, of the fourth, smaller circumference. Thus hydraulic forces likewise act on the piston relative to the mandrel, also urging the piston in a downstream direction.

Said tool can be a drill-string stabiliser, in which case said mandrel has wedge surfaces to engage corresponding surfaces on radially disposed pistons slidable in the body, whereby, when the mandrel moves from said deactivated to said activated position, the pistons extend from the body increasing the working diameter of the stabiliser.

Other features and advantages of the invention will be apparent from the following description, the accompanying drawing and the appended claims.

BRIEF DESCRIPTION OF THE DRAWINGS

Embodiments of the invention are further described hereinafter, by way of example, with reference to the accompanying drawings, in which.

DESCRIPTION OF THE INVENTION

Figures 1A, 1B, 1C:
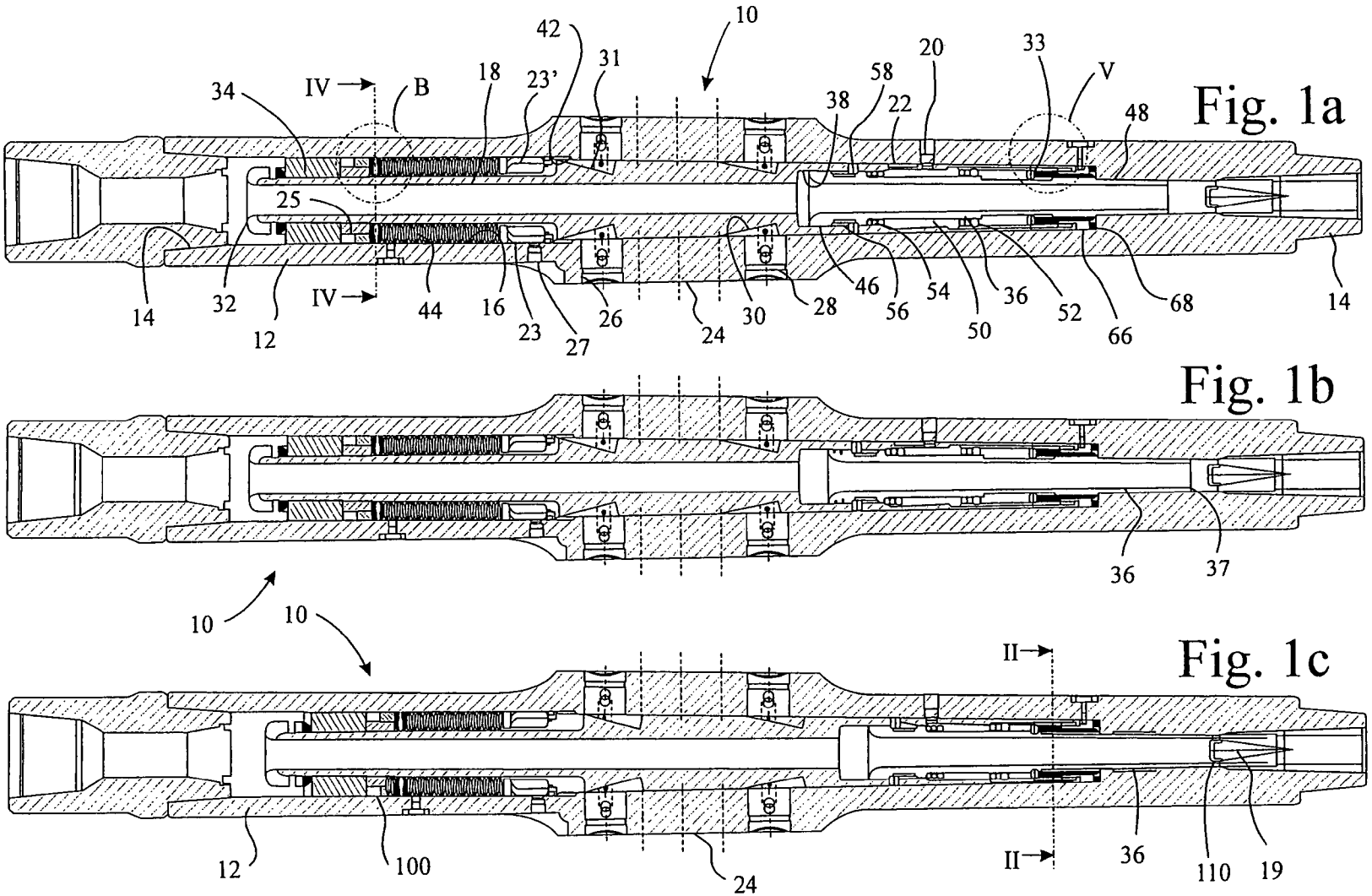
FIGS. 1*a, b* and *c* are side sections through the tool in accordance with the present invention, in different positions thereof.

In the drawings, a stabiliser 10 comprises a body 12 connectable to a drill string (not shown) by means of male and female connectors 14 at either end thereof. A bore 16 extends from one end of the body 12 to the other, to permit flow of mud to lubricate the drill bit (not shown) at the end of the string. Slidable in the bore 16 is a mandrel 18 which is rotationally fixed therein by virtue of a stud 20 in the body 12 which extends into a slot 22 in the mandrel 18. The slot 22 extends axially of the mandrel 18 permitting axial movement thereof within the body 12.

Spiral blades 24 are defined on the surface of the body 12 and bear against the surface of the bore hole (not shown) being drilled to guide the drill bit. The blades permit the return passage of drilling mud by being spaced around the body 12. The blades 24 have radial bores 26 defined in spaced relation along each blade 24. Within each bore 26 is a piston 28 urged radially inwards by springs (not shown). The base of each piston is formed with a wedge surface 30 against which a wedge 31 of the mandrel 18 acts. Thus, if the mandrel moves rightwardly in the drawings, the pistons 28 are thrust radially outwardly projecting beyond the circumference of the stabiliser 10 defined by the blades 24, (see FIG. 1*c*). In this way, the working diameter of the stabiliser increases with the faces of the pistons 28 bearing against the wall of the bore hole.

A collar 25 is screwed onto the mandrel 18 at its upstream end 32 (see also FIG. 4). Above the collar 25 is a seal sleeve 34 which is sealed both to the mandrel 18 and the bore 16 of the body 12. At its downstream end 33, the mandrel receives a control piston 36. The control piston is slidable in a bore 38 of the mandrel which extends from its upstream end 32 to its downstream end 33. The control piston carries seals 46 which seal the piston with respect to the mandrel 18. The piston 36 extends out of the end 33 of the mandrel 18 and is itself sealed at 48 to the bore 16 of the body 12.

As far as the body 12 is concerned, the mandrel and piston are a single unit, and it can be seen that the circumference of the sleeve seal 34 in the body 12 is much larger than the circumference of the seal 48 around the piston 36. Consequently, hydraulic pressure of the mud in the tool 10 results in a larger downward force acting at the end 32 of the mandrel 18 via the seal sleeve 34, than acting in the reverse direction on the piston 36 through its seals 48.

Springs 44 act between a shoulder 42 in the body 12 (via compensation device 23 described further below) and the collar 25 on the mandrel 18, urging the mandrel in the upstream direction. Should the pressure differential be such that the force acting on the mandrel exceeds the return force of the spring 44, the mandrel will move rightwardly in the drawing.

Likewise, hydraulic pressure acting on the control piston 36 across the circumference of its seals 46 to the mandrel result in a downward force on the piston 36 because the circumference of the seal 48 to the body 12 is smaller than seal circumference 46. Again, springs 50 act between shoulder 52 in the mandrel 18 and shoulder 54 on the piston 36 to urge the piston in an upstream direction. Again, should the hydraulic pressure be such that the force of the springs 50 are overcome, the piston 36 will move rightwardly in the drawings.

Figure 3A:
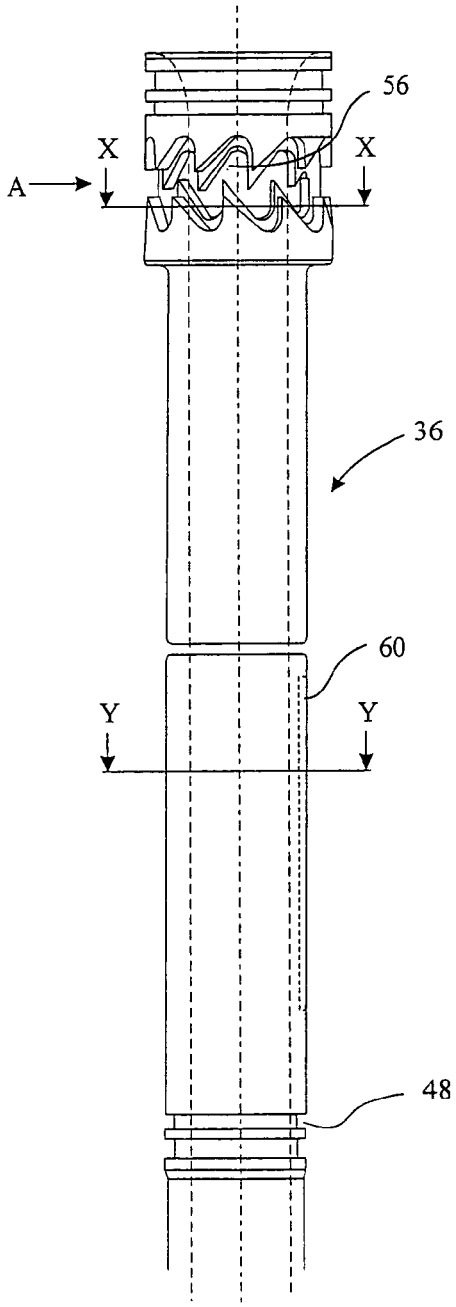
FIGS. 3*a, b, c* and *d* are, respectively, a side view of a control piston of the tool of FIG. 1, a section on the line X—X in FIG. 3*a*, a section on the line Y—Y in FIG. 3*a* and a detailed view of the barrel cam in the direction of arrow A in FIG. 3*a;*
Figure 3B:
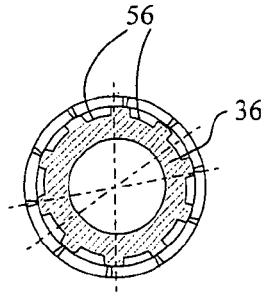
Figure 3C:
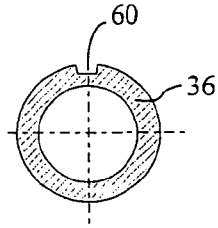
Figure 3D:
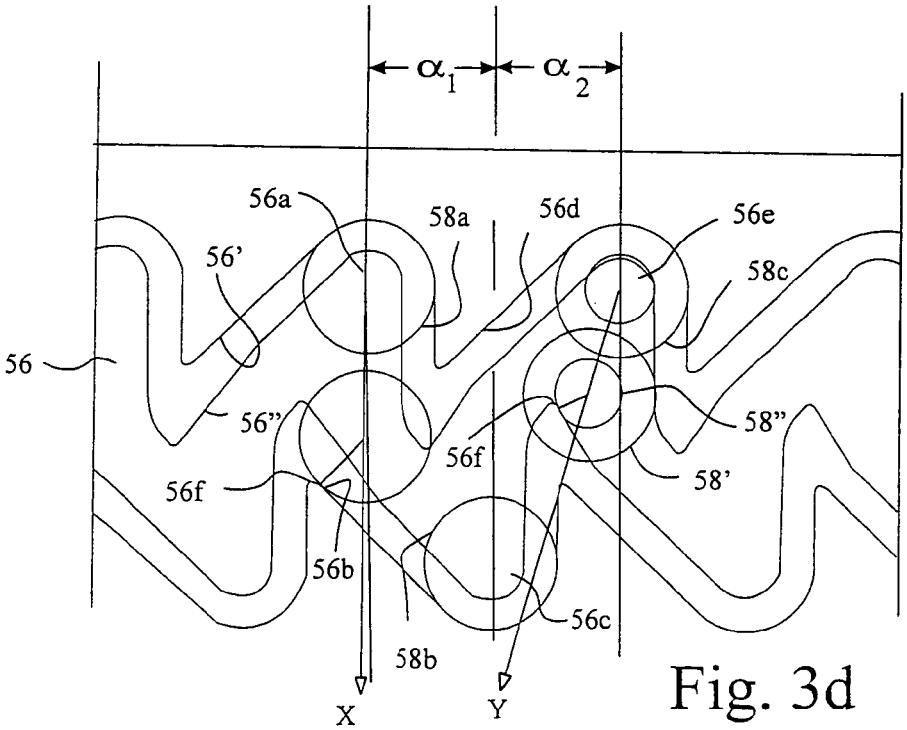

The piston has a barrel cam 56 defined in its surface (see FIG. 3*a*). Pins 58 in the mandrel are received within the confines of the barrel cam 56 so that movement of one relative to the other forces the piston to follow a course defined by the barrel cam 56. If the mandrel is considered, for the moment, to be stationary, then, as hydraulic pressure increases in the bore 38 of the mandrel 18, the piston 36 begins movement from left to right (with reference to FIG. 1*a*). Suppose the pins 58 start at position 58*a*, for example (see FIG. 3*d*), where they lie at the base of a first notch 56*a* of the barrel cam. They will thus move, relatively to the barrel cam 56, until they contact the opposite wall thereof at 56*b*. Further axial movement of the piston 36 then only occurs when the piston rotates through a small angle $\alpha_1$, so that the pin 58 effectively moves to position 58*b* in notch 56*c* on the opposite side of the barrel cam 56 from notch 56*a*.

Should the hydraulic pressure be released, return springs 50 force the piston 36 leftwardly in the drawings (FIG. 1*a*–*c*). The pin 58 is obliged to follow a course from position 58*b* in notch 56*c* of the barrel cam 56, axially until the opposite wall of the barrel cam 56*d* is contacted. Thereafter, further axial movement of the piston can only occur on further rotation of the piston. In this event, the pin moves to the base of notch 56*e* on the same side of the barrel cam 56 as notch 56*a*. In this movement, the piston has rotated through a further angle $\alpha_2$, which is not necessarily the same as $\alpha_1$. Nevertheless the sum $(\alpha_1+\alpha_2)$ is equal to $2\alpha$, the angle of rotation of the piston 36 on one complete return stroke thereof in relation to the mandrel 18.

A subsidiary feature of the barrel cam 56 and pins 58 is that the pins 58 have a large diameter section 58' and a small diameter end 58". The barrel cam has a correspondingly wide slot 56' and a deeper, narrow slot 56", so that the wide slot 56' accommodates the large diameter section 58' of the pin 58, while the narrow slot 56" accommodates the thin pin end 58". The purpose of this is that a wide slot is inevitably somewhat coarse compared with a narrow slot, which can be precise. On the other hand, a wide slot with a large diameter pin significantly reduces point loads, both on the pin and cam surface it is following. Given that the control piston is spring loaded, it inevitably resists rotation due to frictional forces, although these can be alleviated, for example, by employing a thrust bearing between the spring 50 and piston 36. However, even with this measure, if only a coarse cam surface 56' and large pin 58' is employed, then, in moving from notch 56*a* to contact surface 56*b*, a rotational drift back in the direction of Arrow X in FIG. 3*d* of only 1° can be permitted. Any greater drift, which would generally be caused by the spring having been "wound up" by previous movements, would cause contact of the pin 58' with point 56*f* of the cam 56', such that secure guidance of the pin to notch 56*c* could not be guaranteed. Because slot 56" can be more precise, however, the permitted angle of drift can be much greater, such as 15° (see Arrow Y in FIG. 3*d*), while still ensuring that the pin is guided correctly and rotation of the piston 36 in the correct direction is guaranteed. At the same time, however, it is only during these extreme situations that loading only occurs through the narrow slot 56" and thin pin end 58". Most of the time, and indeed mostly all the time when thrust bearings are employed, both surfaces 56' and 56" are contacted by both pin parts 58' and 58", so that wear on the pin 58 and slot 56 is minimised, even though accurate guidance is ensured.

Indeed, as mentioned above, an alternative approach is to provide a separate component on the piston which is freely rotatable (but axially fixed) thereon and which has the barrel cam or the cam follower mounted on it. The separate component is then employed to rotate the sleeve and at least the frictional resistance to rotation of the piston (through its contact between its seal and other components with the mandrel and/or body) is avoided. (See, for example, the description below in relation to FIGS. 9*a* to *c* and 10, although there, the separate component also constitutes the sleeve or, as described below, carries itself one set of castellations while the other set is on the sleeve, which sleeve is fixed in the body).

Figure 5A:
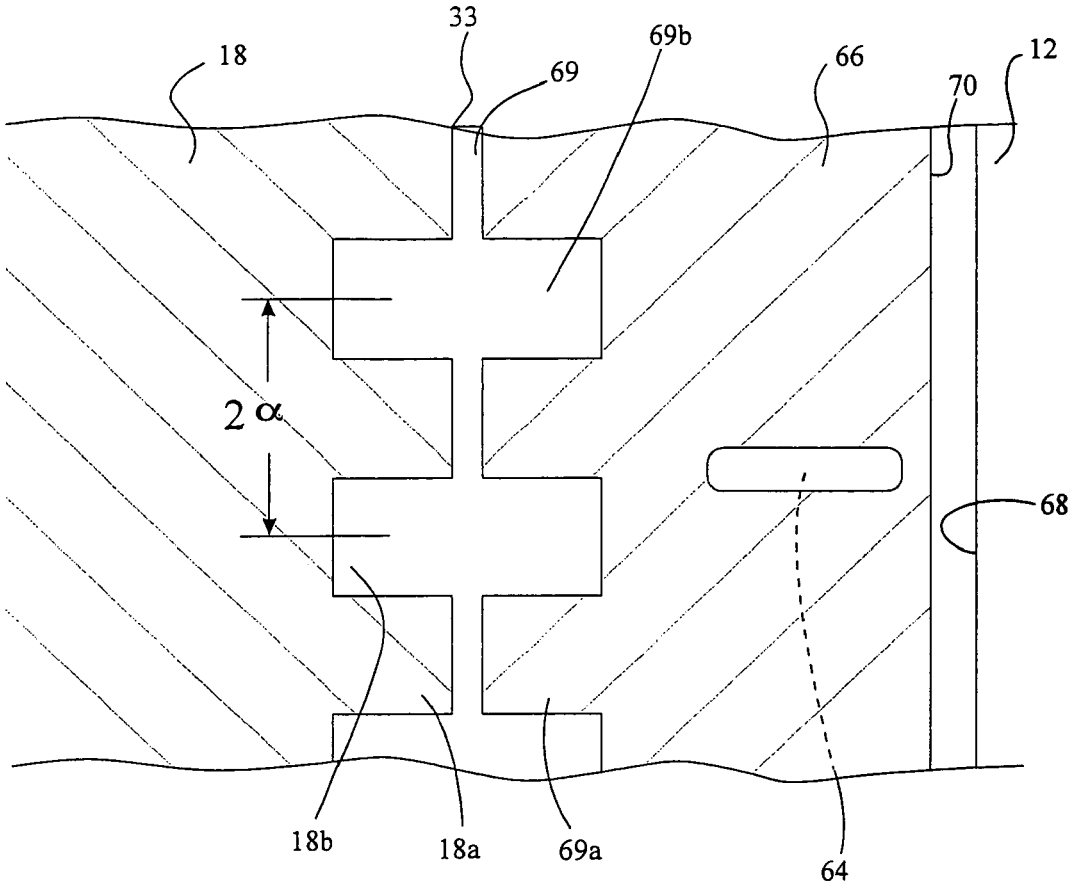
FIGS. 5*a* and *b* are , respectively, a view in the direction of arrow A in FIG. 5*b*, and an expanded view of detail V in FIG. 1*a;*

As shown in FIGS. 3*a* and *c*, the piston 36 has a longitudinal slot 60 in which is received a key 64 of a castellated sleeve 66 (see FIGS. 5*a* and *b* for more details).

The sleeve 66 is received between a shoulder 68 of the body 12 and end 33 of the mandrel 18. The end 33 of the mandrel 18 is castellated having fingers 18*a* and slots 18*b*. The end 69 of the sleeve 68 is likewise castellated having fingers 69*a* and slots 69*b*. When the fingers 18*a*,69*a* of the mandrel and sleeve are in phase with one another, as shown in FIG. 5*a*, then rightward movement of the mandrel 18 in the drawings, is limited, with the fingers 18*a*,69*a* abutting one another and the other end 70 of the sleeve 66 abutting shoulder 68 of the body 12.

On the other hand, however, when the sleeve 66 is out of phase with respect to the mandrel 18, fingers 18*a* face slots 69*b* and fingers 69*a* face slots 18*b* so that, when the mandrel 18 moves rightwardly in the drawings, the castellations on the mandrel and sleeve interdigitate so that further rightward movement of the mandrel 18 is possible than when the castellations are in phase. The angular separation of the fingers and slots in the mandrel and sleeve is arranged to be the same angle $2\alpha$ (or multiples thereof), as described above.

Consequently, when the piston makes a complete return stroke serving to rotate the sleeve 66 through the angle $2\alpha$, the sleeve 66 moves from an in-phase position to an out-of-phase position, or vice versa.

Figure 2:
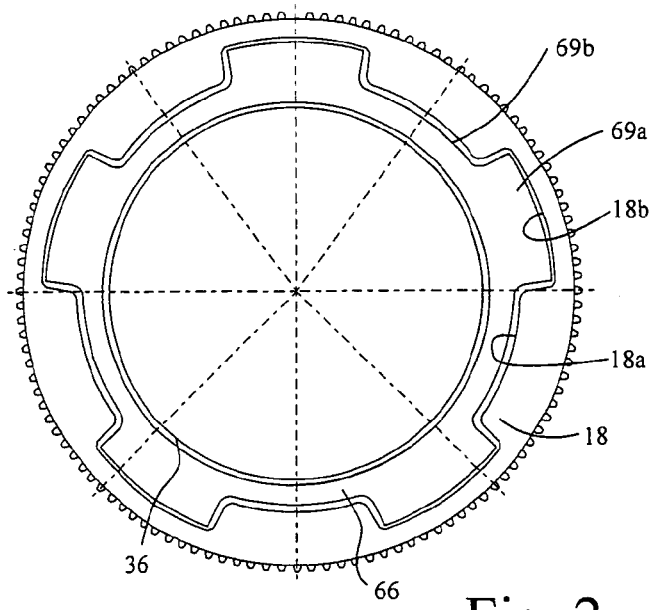
FIG. 2 is a section on the line II—II in FIG. 1*c;*

Although FIGS. 5*a* and *b* show fingers 18*a*,69*a* and slots 18*b*,69*b* extending across the thickness of both the mandrel 18 and sleeve 66 respectively, in FIG. 2, it can be seen that the respective fingers and slots extend only across a portion of the thickness of each element 18,66. Both arrangements are functionally identical, the arrangement in FIG. 2 merely being mechanically more sound.

Figure 6:
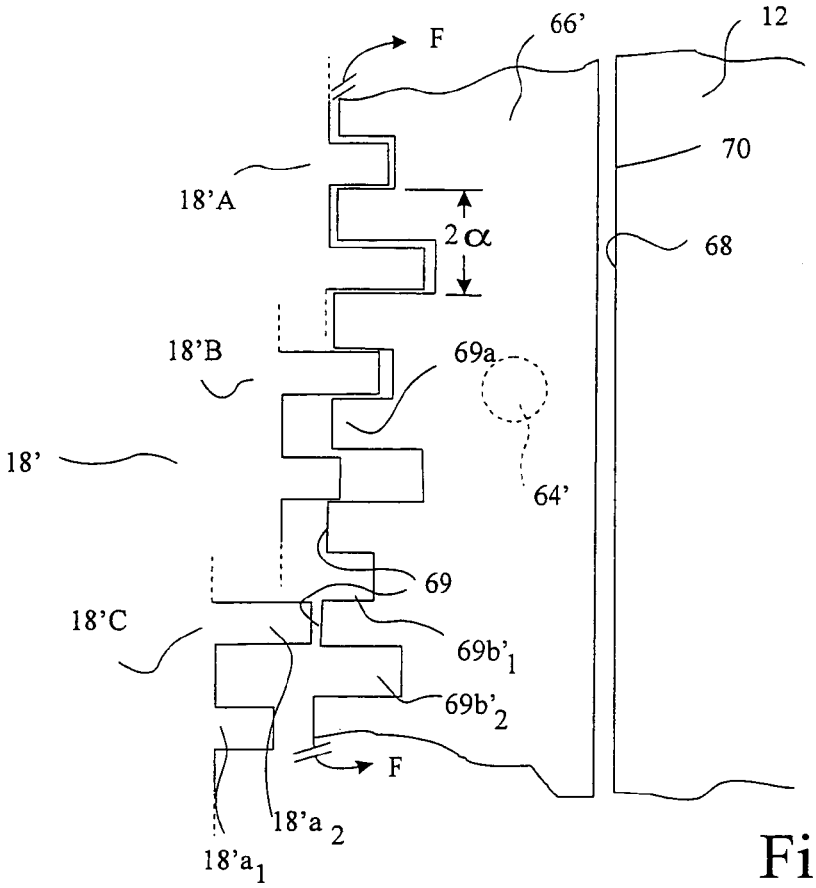
FIG. 6 is a view similar to FIG. 5*a*, but of an alternative embodiment of the present invention.

Turning now to FIG. 6, an alternative arrangement is shown to that described above with reference to FIG. 5*a*. Here, the sleeve 66' has alternate slots 69*b'* which have different depths (shallow, $\mathbf{69}b'_1$ and deep, $\mathbf{69}b'_2$). Similarly, the mandrel 18' has alternate fingers 18*a'* which are correspondingly short, $\mathbf{18}a'_1$ and long $\mathbf{18}a'_2$. Such an arrangement necessitates, of course, an even number of fingers and slots around the sleeve 66' and mandrel 18', which has a consequent effect on the barrel cam 56. In the previous embodiment, there were five fingers/slots around the periphery (as shown in FIG. 2), meaning that angle $2\alpha$ was 72° of rotation. Here, there are preferably six fingers/slots, so that angle $2\alpha$ is 60°.

Figure 5B:
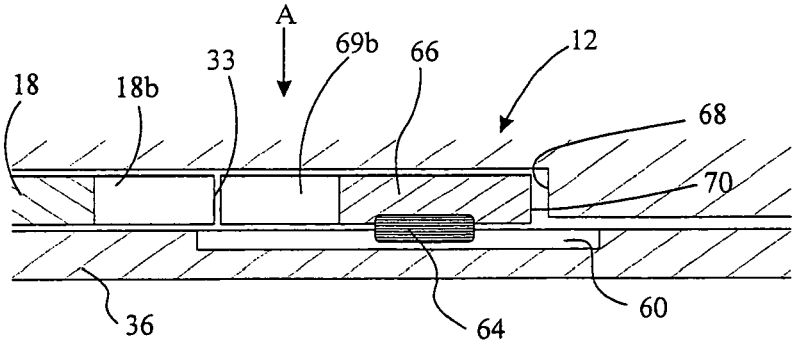

The result of varying depth of fingers 18*a*' and slots 69*b*' is that mandrel 18 can have three positions instead of just two, that is to say an intermediate position between deactivation and full activation. In FIG. 6 at its top, the mandrel is shown in its fully activated position 18'A, in which long fingers $\mathbf{18}a'_2$ coincide with deep slots $\mathbf{69}b'_2$, so that this corresponds entirely with at activated position of the previous embodiment, At the bottom of FIG. 6, the fingers $\mathbf{18}a'_2$ coincide with the fingers 69*a* of the sleeve 66' (which fingers are all level, as in the embodiment described with reference to FIG. 5*a*), so that the mandrel is in its deactivated position 18'C, again corresponding with the deactivated position of the previous embodiment and as shown in FIG. 5. However, in the middle of FIG. 6, there is shown the intermediate position 18'B in which long fingers $\mathbf{18}a'_2$ coincide with shallow slots $\mathbf{69}b'_1$, with the result that the pistons 28 are only displaced radially outwardly to a lesser extent.

Figure 4A:
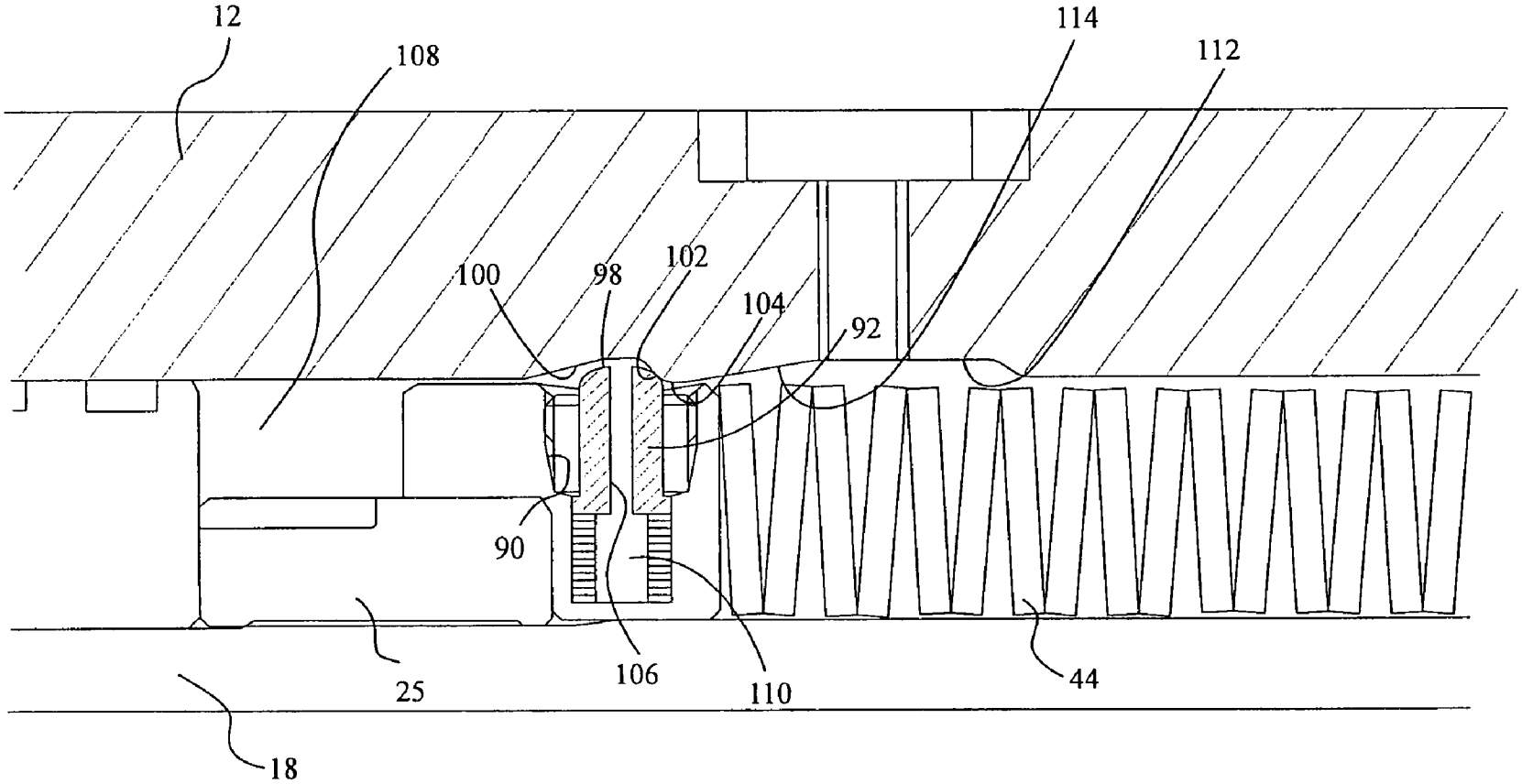
FIGS. 4*a* and *b* are, respectively, an expanded side view of detail B in FIG. 1*a*, and a side section on the line IV—IV in FIG. 1*a;*

Returning to FIG. 1*a* and with reference also to FIGS. 4*a*, and *b*, the mandrel has on the collar 25 a series of pockets 90 in which a plunger 92 is disposed. Springs 94 press the plunger radially outwards, the plungers being retained in the pockets 90 by threaded retainers 96. The head 98 of each plunger 92 is received within a circumferential groove 100 in the body 12. It is therefore apparent that rightward movement of the mandrel in the body 12 is only possible if the plungers 92 are first pressed radially inwardly. For this purpose groove 100 is provided with an angled cam surface 102. Thus when the mandrel is pressed sufficiently strongly in the rightward direction in the drawings, the returning force of the springs 94 may be overcome and the plungers (92) are pressed radially inwardly so that they pass over lip 104 of the groove 100. In order to ensure that hydraulic effects do not influence the operation of this detent represented by the plungers 92, each plunger has a through bore 106 connecting space 108 between the mandrel 18 and body 12 with space 110 behind the plunger 92 and within the pocket 90.

Figure 4B:
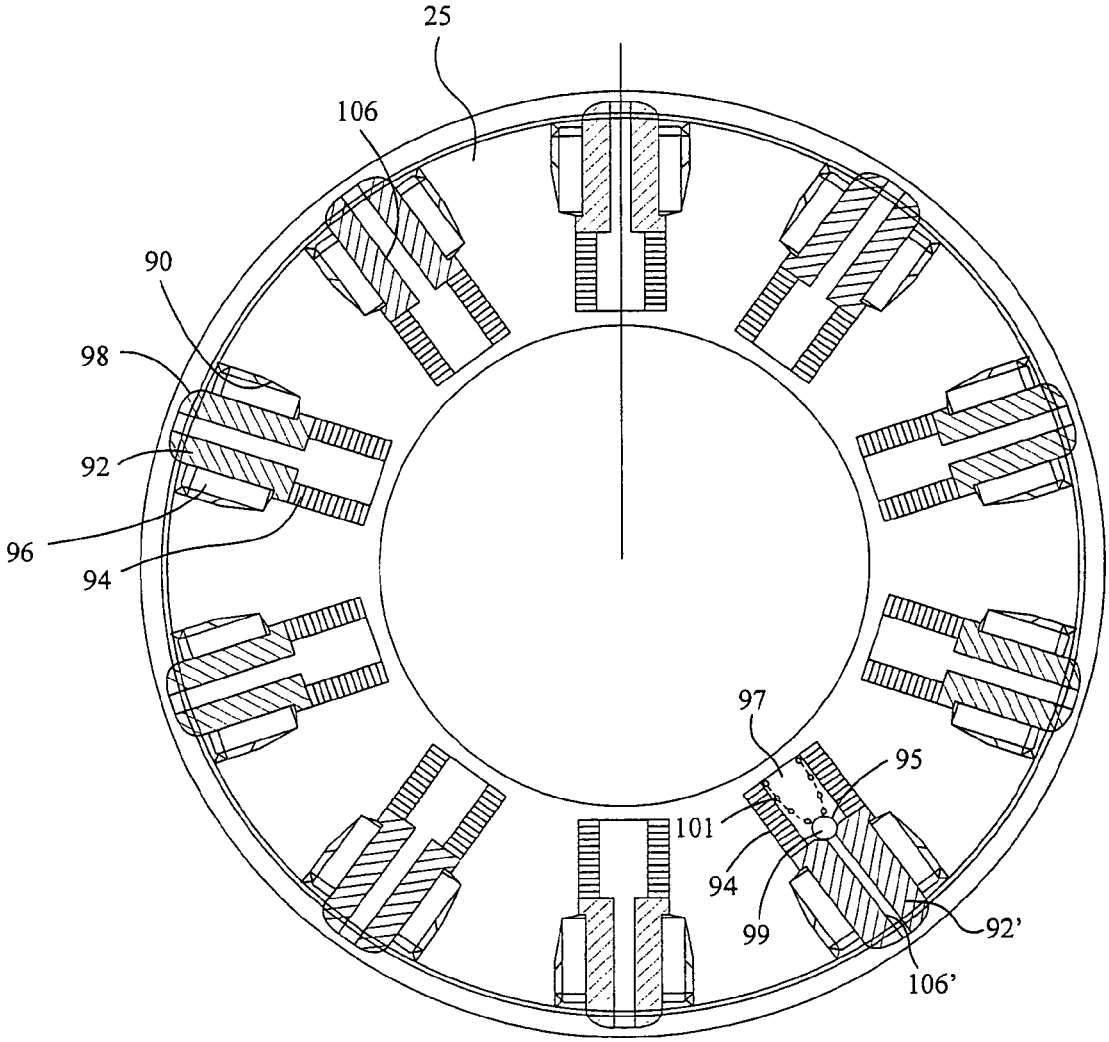

While the detent plungers are shown spring loaded, the same result could be achieved with the plungers forming pistons as shown at 92' in FIG. 4*b*. Fluid behind the pistons here resists their radially inward displacement until the fluid leaked out around the sides thereof. Nevertheless, a return spring 94 is still required, and moreover a return flow path 106' guarded by a check valve 95 is also required. The check valve comprises a ball 99 and spring 101 and it inhibits fluid leaving the space 97 behind the piston 92', but permits in-flow when the springs 94 push the piston 92' out.

In operation of the stabiliser 10, therefore, and beginning with the positions shown in FIG. 1*a*, a user at ground level who wishes to increase the working diameter of the stabiliser 10 increases the flow and pressure of drilling mud down the bore of the drill string so that hydraulic pressure begins to act on the components within the stabiliser tool. Because of the detent represented by the plungers 92, the mandrel is at first prevented from moving. However, the piston 36 has no such detent and so commences to move rightwardly in FIG. 1*a* against the pressure of spring 50. Rightward movement of the piston 36 is thus accompanied by rotation thereof through the angle $\alpha_1$ which, for the sake of argument, rotates the sleeve 66, via the key 64 sliding in the slot 62 of the piston 36, to the position shown in FIG. 5*a* where the fingers 69*a* of the sleeve 66 are in phase with the fingers 18*a* of the mandrel 18. It must be borne in mind that the mandrel 18 is rotationally fixed in the body 12 by pin 20 received in slot 22. Thus, even if the pressure in the tool 10 should continue to rise sufficient to release the detent plungers 92 from the slot 100, the mandrel 18 cannot move much further rightwardly than shown in FIG. 1*a* by virtue of the fingers 18*a* at the end 33 of the mandrel contacting the fingers 69*a* of the sleeve 66. Indeed, such movement as there is merely takes up the clearance between the fingers 18*a*,69*a*, and between end 70 of the sleeve 66 and shoulder 68.

However, should it be desired by the user that the stabiliser operate in its maximum working diameter, the operator reduces the pump pressure so that the spring 44 returns the mandrel (to the extent that this is necessary) to the position shown in FIG. 1*a*. The springs 50 also return the piston from the position shown in FIG. 1*b* to that shown in FIG. 1*a*. In doing so, the piston rotates through the further angle $\alpha_2$. On the next occasion, therefore, that the hydraulic pressure is increased again so that the piston 36 moves once again towards the position shown in FIG. 1*b*, and it rotates through a further angle $\alpha_1$, then, on this occasion, the castellations on the mandrel 18 and sleeve 66 will be out of phase. Consequently, once the hydraulic pressure rises sufficiently to force the mandrel past the detent plungers 92, the mandrel will move fully rightwards as shown in FIG. 1*c*, with the respective castellations on the mandrel and sleeve interdigitating.

In this position, as shown in FIG. 1*c*, an end 37 of the piston 36 moves into close proximity with a plug 19 in the body 12, with the result that a substantial constriction 110 is created in the fluid flow. The operator at ground level is then advised that the mandrel has moved to its activated position by a sudden rise in pump working pressure.

Here, as shown in FIG. 1*c*, the pistons are pressed radially outwardly so that they stand proud of the surface of the blades 24 and increase the working diameter of the stabiliser 10.

It will be apparent to the skilled reader that, in moving within the body 12, the mandrel 18 and piston 36 compress the space between the body and mandrel/piston and defined by the seals 34,48 and primarily occupied by the space containing springs 44 and 50 and sleeve 66. This space is filled with hydraulic oil and is isolated both from fluid pressure external of the stabiliser 12, as well as hydraulic pressure internally of the bore 38. Thus firstly there is a requirement to provide for relief of the oil in that space as the mandrel moves and compresses that space. Secondly, since the hydraulic pressures both internally and externally are intense, a means to match pressure in that space is desirable in order to avoid disruption of the seals.

For this purpose, pressure relief chamber 23 is provided. This chamber is of known construction per se and consequently only brief description is required here. Chamber 23 comprises an annular bellows 23' which, internally, is in fluid communication with the space around springs 44 and 50 and sleeve 66, and externally is in communication with the outside environment through port 27. Thus the pressure in the space referred to must correspond with the outside pressure. The chamber 23 is itself sealed to the bore 16 of the body 12, but not to the mandrel 18. The movement of the mandrel and compression of the space around spring 44 is also, indeed primarily, taken up by radially outward movement of the pistons 28.

Referring again to FIG. 4*a*, on rightward movement of the mandrel 18, the detent plungers 92 move into over lip 104 into a shallow groove 112 in the body 12, which has a much less steep return face 114. Consequently, springs 44, once hydraulic pressure has been released, have no problem in compressing plungers 92 to return them over lip 104.

By this arrangement, two connected effects are experienced. The first is that the piston 36 moves with very little extraneous loading upon it. Thus the mandrel 18 is held in position by the detent plungers 92 so that sleeve 66 is freely rotatable between the end 33 of the mandrel 18 and the shoulder 68 on the body 12 by movement of the piston 36. Consequently there is little wear on the barrel cam 56 or the pins 58 received therein. Secondly, because the fingers 18*a*,69*a* have no function beyond meeting one another and resisting the heavy forces imposed by the hydraulic pressure, or inter-digitating when out of phase, they can be substantial components with little need to provide mutually sliding surfaces, for example. Thus they are able to be made as structurally strong components less liable to fail, without adversely affecting operation of the stabiliser.

It is intended that the present invention operates (that is to say toggles between positions) at pressures well below normal operating pressures of the drill string, which may be in the region of 500 psi or more. At these pressures, the control piston is designed to remain in the position shown in FIG. 1*b* or 1*c* relative to the mandrel, the latter being in either of its activated or deactivated positions (the fingers and slots on the mandrel and sleeve being entirely in-phase or entirely out-of-phase). On rising from zero pressure, both the mandrel and control piston would begin to move together but, due to the strength of the springs and their design the piston can be arranged to have completed its stroke before the mandrel has substantially begun to move. In any event, as mentioned above, the detent mechanism actively prevents the mandrel moving until the forces on it exceed a predefined limit. Indeed, that limit is arranged so that, once the detent has been released, the mandrel moves from its start position to its final position without further increase in pressure. In other words it is a clean switching action.

Figure 8A:
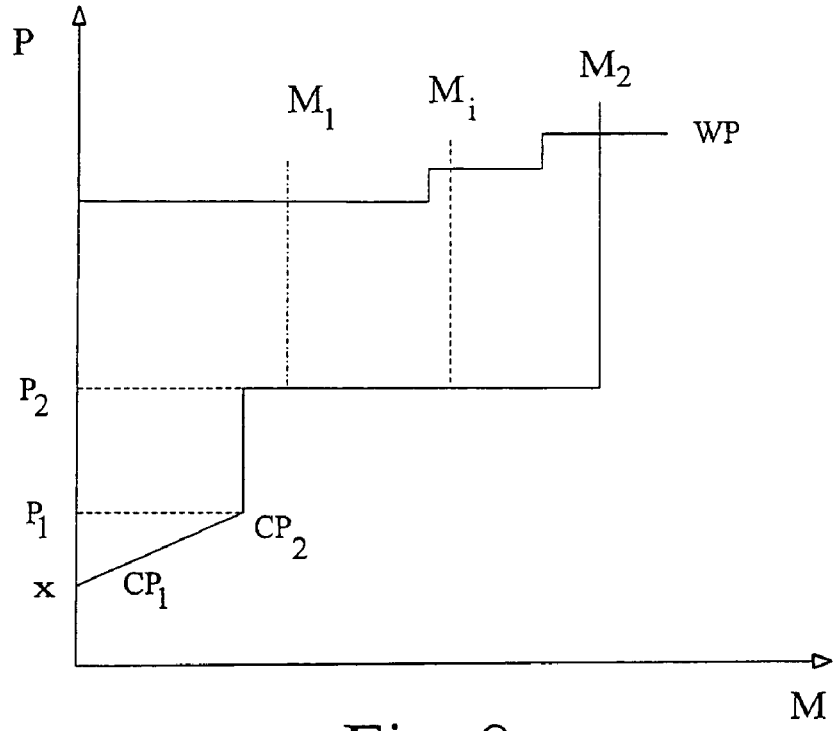
FIGS. 8*a* and *b* are graphs showing changes in mud pump pressures with mandrel position and time, respectively.

This is illustrated in FIG. 8*a* which is a graph of mud pump pressure (P) versus position (M) of the end 37 of the piston 36 with respect to its position shown in FIG. 1*a*. As pressure increases from some value x above zero (there will be a preset loading of the spring 50) to $P_1$, the control piston moves gradually from $CP_1$ to $CP_2$, ie to the position shown in FIG. 1*b*. Thereafter there is no movement until the pressure reaches $P_2$, whereupon the detent mechanism is overcome and the mandrel moves from position $M_1$ to $M_2$, being the position shown in FIG. 1*c* without further change in pressure P. Of course, should the fingers 18*a*,69*a* be in phase, then the mandrel will stay at $M_1$ and further increase in pressure will follow the phantom line in FIG. 8*a*. If the stabiliser is as the alternative embodiment described with reference to FIG. 6, then the mandrel may move instead to position $M_i$, being the intermediate position, and further increase in pressure will follow the dashed line in FIG. 8*a*. In any event, all lines will reach working pressure WP, except that it will be less when the mandrel is in position $M_1$ than $M_2$, because of the constriction 110 caused by plug 19.

Turning to FIGS. 7*a* to 7*d*, there is shown an arrangement of the piston 36' and plug 19' which assists in signalling to the user the position that the mandrel is in, and thus the state of activation of the stabiliser 10, when the stabiliser is modified as described with reference to FIG. 6.

Figure 7A:
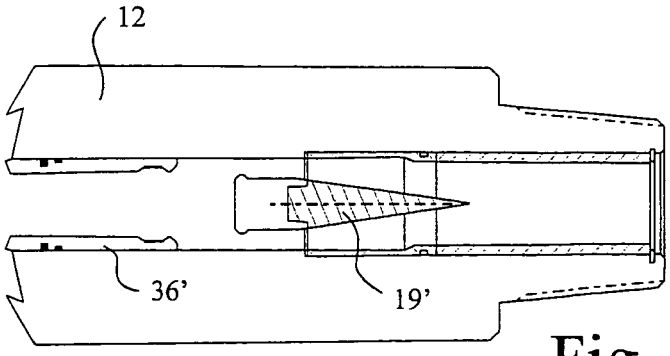
FIGS. 7*a* to *d* are enlargements of one end of the stabiliser according to the embodiment of the present invention shown in FIG. 6, and wherein development of a signalling constriction is shown.
Figure 7B:
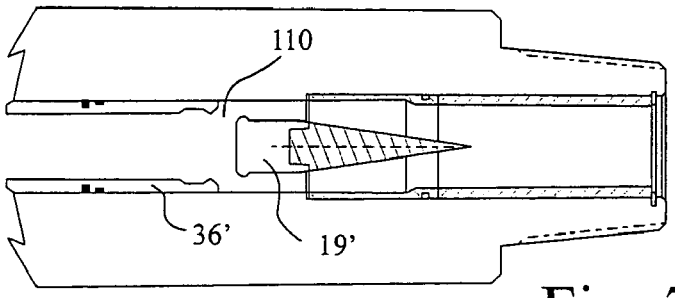
Figure 8B:
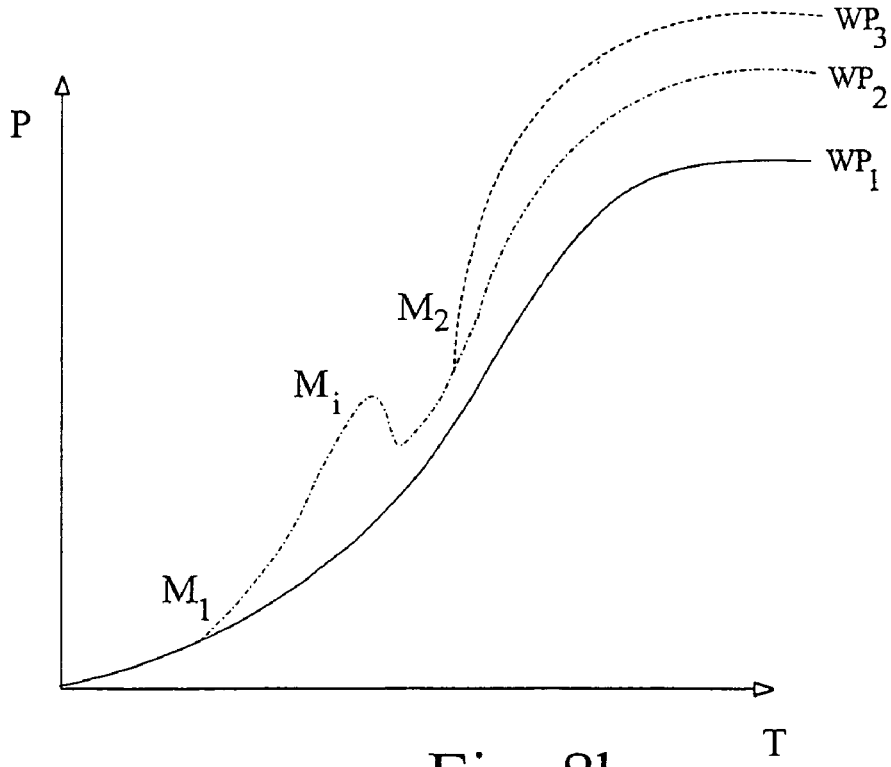
Figure 9A:
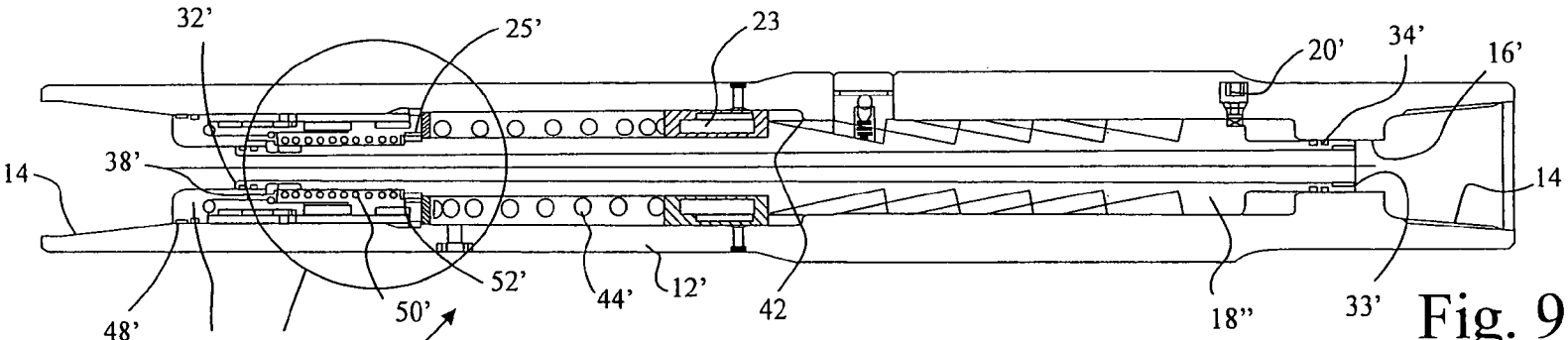
FIGS. 9*a, b* and *c* are side sections through an alternative embodiment of a tool in accordance with the present invention.
Figure 9B:
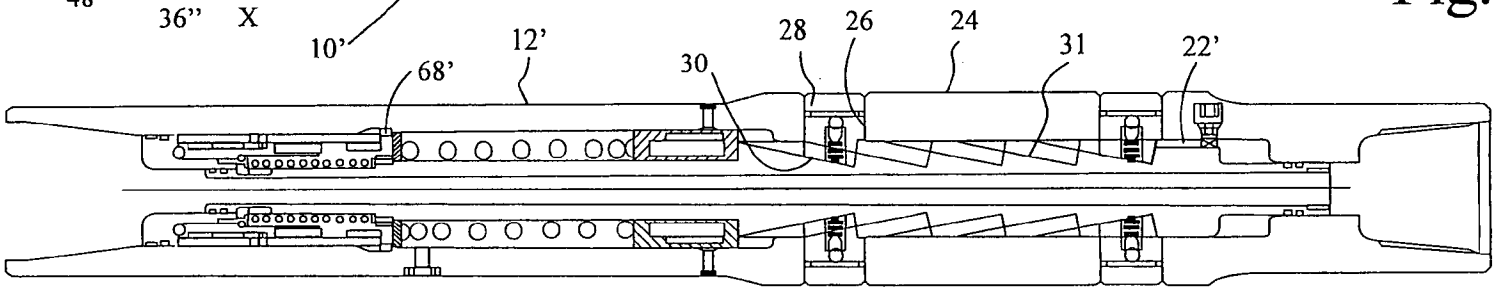
Figure 9C:
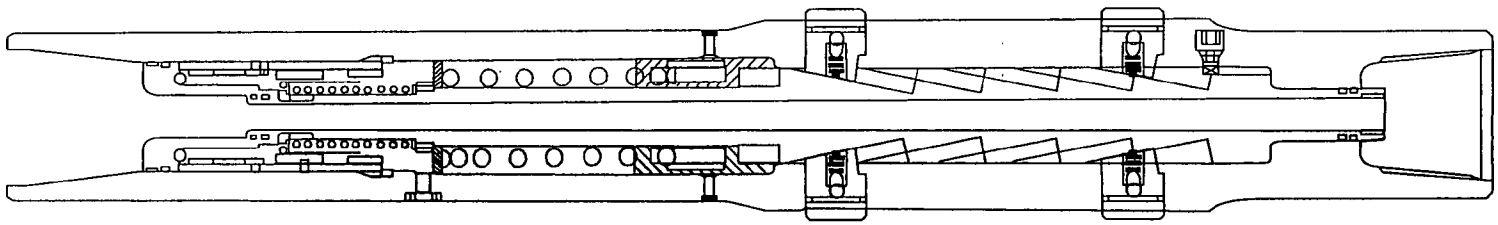

In FIG. 7*a*, the piston 36' is in position $CP_1$, ie no pump pressure. In FIG. 7*b*, it has moved to position $CP_2/M_1$, where constriction 110 is negligible and not yet having any significant effect. A graph of pressure P versus time T is shown in FIG. 8*b*, where it can be seen that reaching position $M_1$ has no precise impact on the shape of the developing pressure. However, if the mandrel stays in the position $M_1$, then the pressure continues to develop to working pressure $WP_1$ along the solid line in FIG. 8*b*.

Figure 7C:
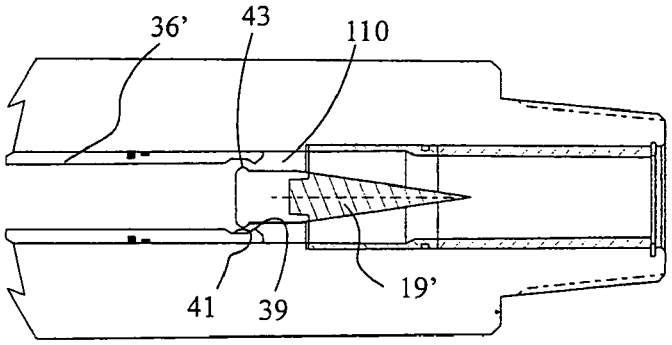

If, on the other hand, the mandrel moves to the intermediate position $M_i$, then the piston moves to the position shown in FIG. 7*c* where an internal lip 39, which is formed by a circumferential groove 41 formed in the bore of the piston 36, passes over a lip 43 on the plug 19'. Here, not only has the constriction 110 formed, but also, in moving to this position a very tight constriction was temporarily formed while the lips 39,43 overlapped. This results in a strong pressure pulse (at $M_i$ in FIG. 8*b*) before the pressure continues rise to $WP_2$, which is higher than $WP_1$ in view of the constriction 110.

Figure 7D:
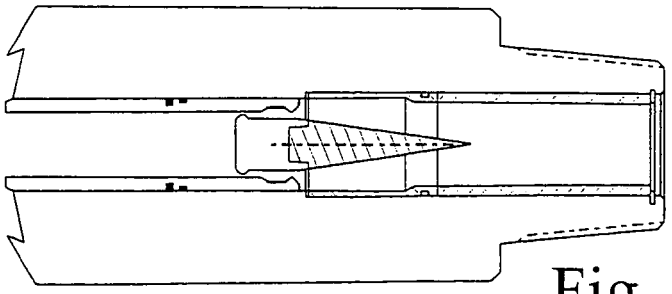

Finally, as the piston moves to the position shown in FIG. 7*d*, where the mandrel is in its fully activated position $M_2$, lip 43 moves over groove 41 and causes an even tighter constriction within the bore of the piston 36'. This further increases the pressure at $M_2$ in FIG. 8*b*, before the pressure continues to rise to $WP_3$ which is again higher than $WP_2$.

Thus by this mechanism not only are the final working pressures different for the different working positions of the mandrel 18, but also a pressure pulse is experienced at each change of position. Indeed, with sensitive detection equipment at the surface and connected to the drilling mud pressure line, it may even be possible to dispense with the constriction 110 per se, and simply rely on the pulses to detect position rather than final working pressures.

Figure 10:
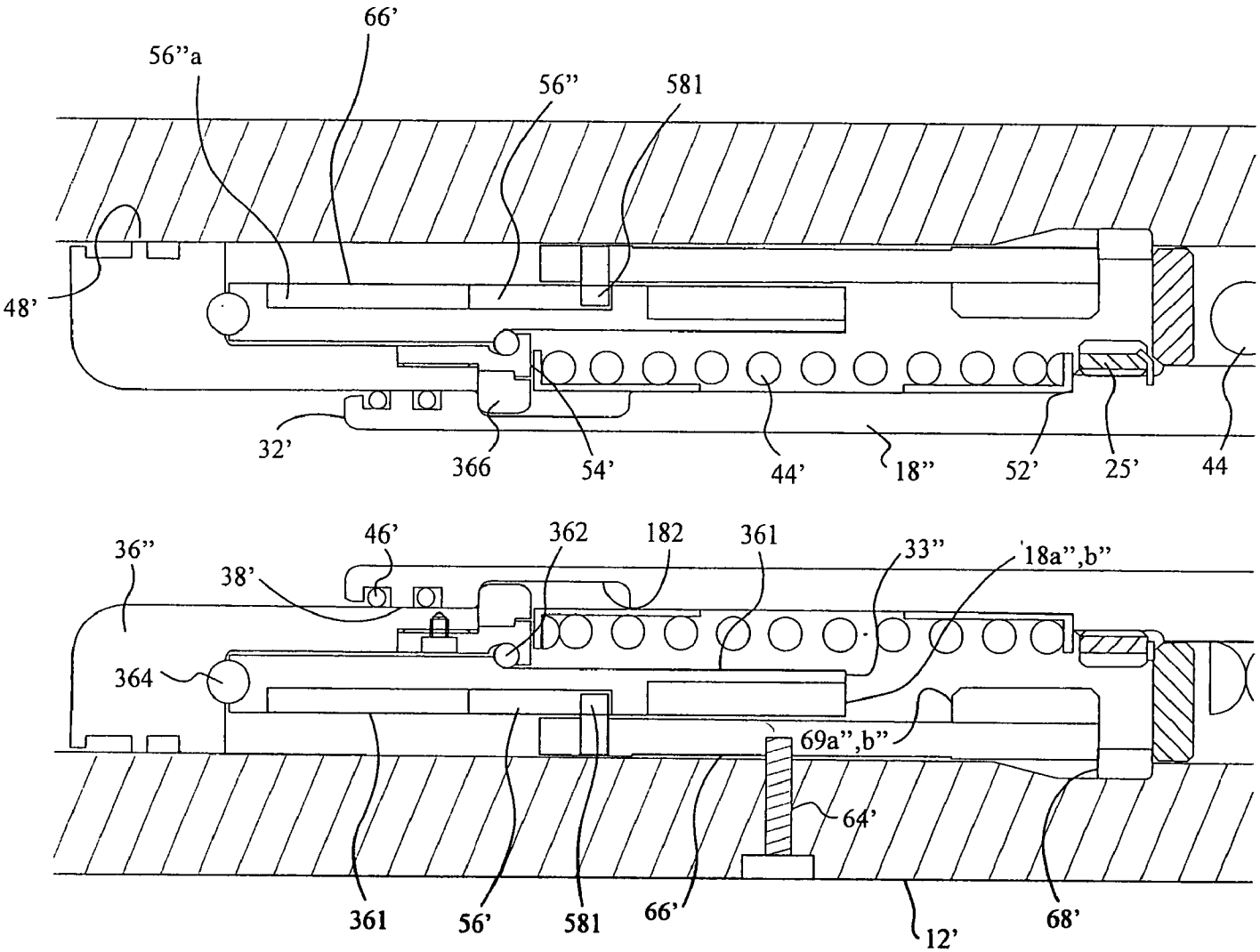
FIG. 10 is a detailed view of the inset marked X on FIG. 9*a;*

FIGS. 9 and 10 illustrate a different embodiment of the present invention in which the control arrangement for movement of the mandrel is moved to the upstream end of the stabiliser. In these figures, parts with equivalent function to the embodiment described with reference to FIG. 1 are given the same references numeral, except for the addition of an apostrophe (') or double apostrophe (") if the element in question differs in any way from previous embodiments.

In this embodiment, the mandrel 18" is a sliding fit inside the piston 36", which is itself a sliding fit in the bore of the body 12'. Instead of the piston rotating, here a component 361 of the piston rotates on it. The component 361 is rotationally mounted through bearings 362, 364 on the piston 36" and rotates relative thereto as the piston moves up and down the body 12'. The cam track 56" is formed on the surface of the component 361, whereas the cam follower pins 581 are mounted on sleeve 66'*b*, which is now effectively just a part of the body 12'. The sleeve 66'*b* is prevented from rotating relative to the body by a bolt 64' or by similar means. A mandrel drive ring 366 is carried by the piston 36" and rides in an annular groove 182 in the mandrel 18". The ring 366 is in two parts and is retained by collar 54' screwed onto the end of piston 36".

An alternative way of looking at component 361 is that it is integral with, and forms, the sleeve 66'*a* of the present invention. In this view, sleeve 66'*b* is merely part of the body 12'.

When mud pressure increases, the piston 36" moves rightwardly in the drawing and, depending on the rotational position of the sleeve 66'*a*, fingers 69*a*"/18*a*" on the sleeve 66'*b* and component 361 either oppose one another or interdigitate with each other falling into slots 18*b*"/69*b*". If they interdigitate, then drive ring 366 hits the end of slot 182 and the piston 36" drives the mandrel rightwardly in the drawing to set it in its full gauge, activated position. If, however, the fingers 69*a*"/18*a*" face one another then even if mandrel 18" slides rightwardly relative to piston bore 36' under the influence of mud pressure (which is minimised by substantial equality of diameter of the mandrel upstream, to the piston, (seal 46') on the one hand, and downstream, to the body, (seal 34') on the other hand), drive ring 366 prevents rightward movement of the mandrel 18" and the mandrel remains in its under gauge or deactivated position of the stabiliser.

In this arrangement, it would also be quite feasible to integrate the springs 44',50' into a single spring. However, to ensure that the piston moved with respect to the mandrel before the mandrel moved with respect to the body, a suitable detent mechanism such as described above is necessary.

It is to be noted that here, the cam track 56" and the component 361 move with the mandrel and therefore cam extensions 56"*a* in an axial direction are needed, at least in positions where the fingers 69*a*"/18*a*" interdigitate and the axial movement of the piston 36' and component 361 is extensive relative to the sleeve 66'*b*.

Figure 11A:
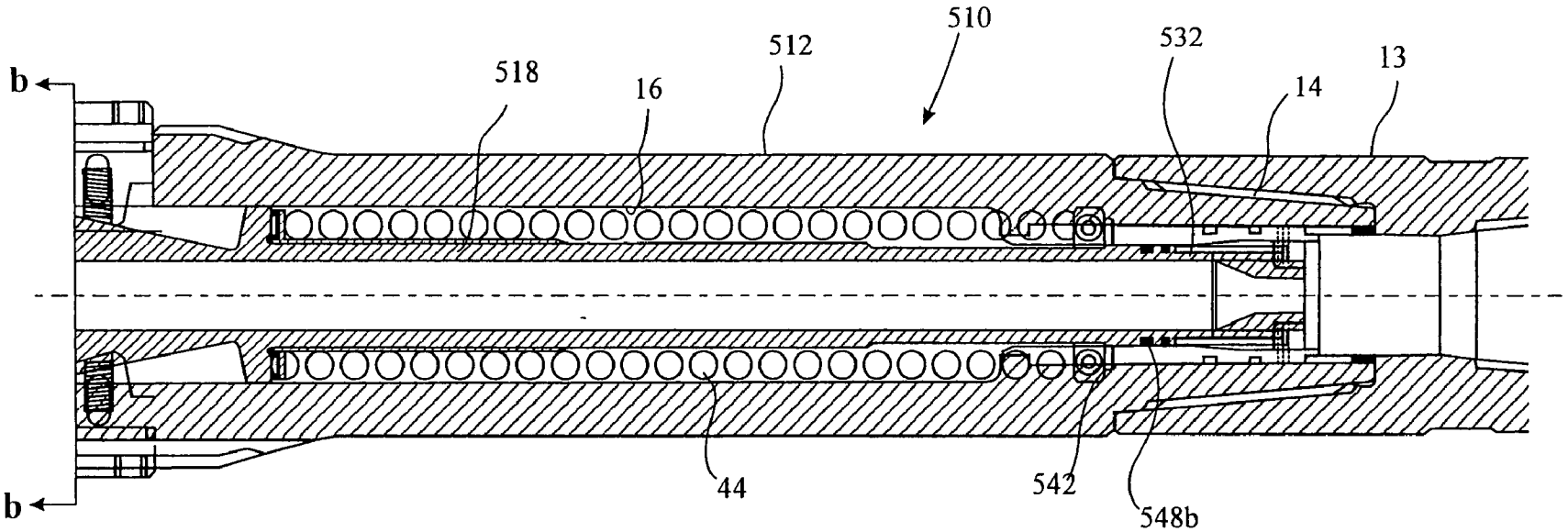
FIGS. 11*a, b* and *c* are part side sections through different parts (downstream, middle and upstream sections) of a stabiliser in accordance with another aspect of the present invention.
Figure 11B:
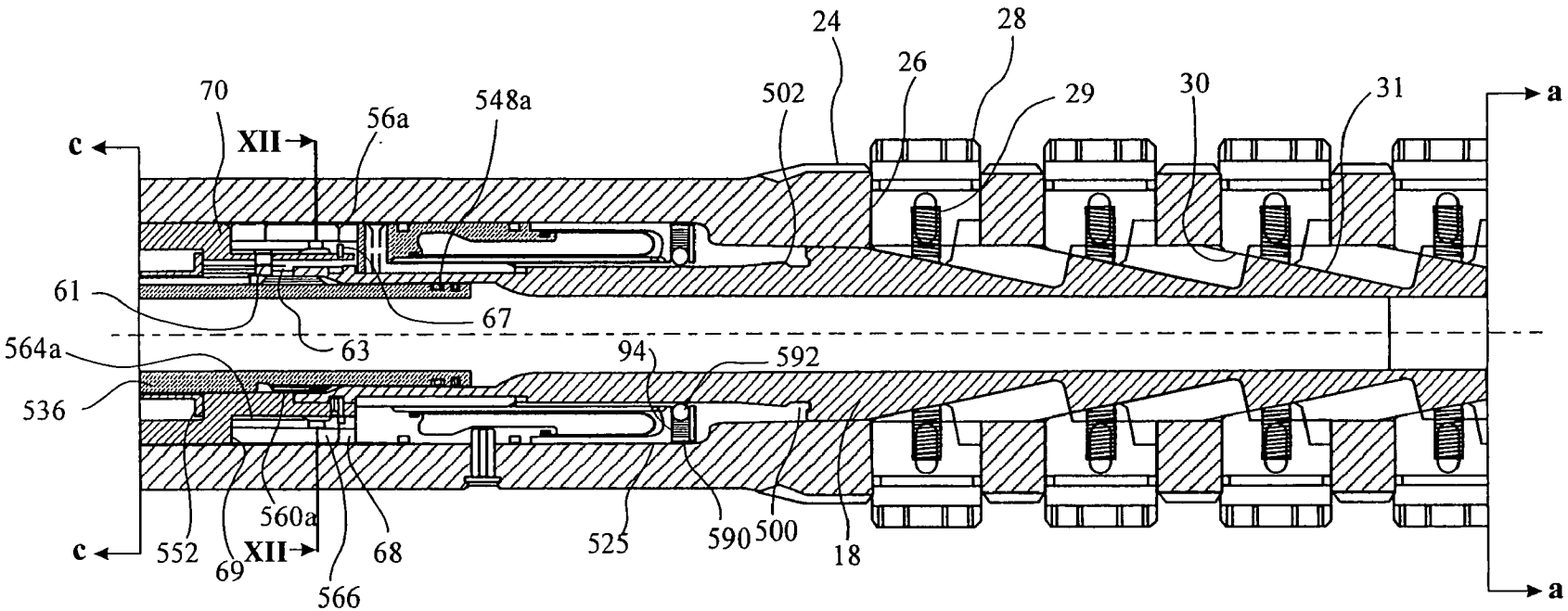
Figure 11C:
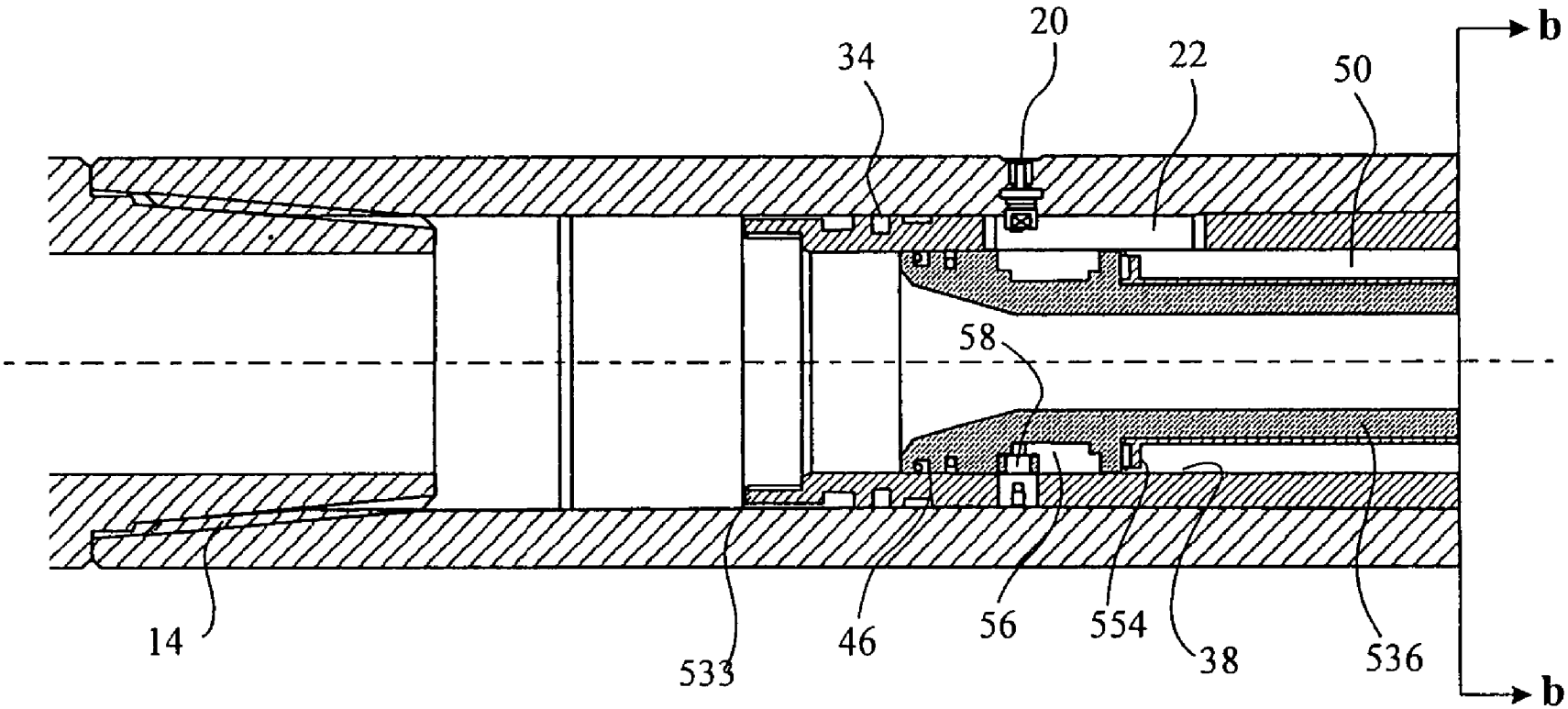

Finally, FIGS. 11*a* through *c* illustrate a currently preferred arrangement in which the piston slides wholly within the mandrel. The same components as in the previous embodiments have the same reference numerals, but variations are here illustrated with a prefix 5 before the number used in earlier embodiments.

The stabiliser 510 comprises a body 512. A bore 16 extends from one end of the body 512 to the other. Slidable in the bore 16 is the mandrel 518 which is rotationally fixed therein by virtue of a stud 20 in the body 512 which extends into a slot 22 in the mandrel 518.

At its upstream end 533, the mandrel receives a control piston 536. The control piston is slidable in the bore 38 of the mandrel, which extends from its upstream end 533 to its downstream end 532. The control piston carries seals 46,548*a* which seal the piston with respect to the mandrel 518. The mandrel is sealed to the body at its upstream end 33 by seal 34, and at its downstream end 532 by seal 548*b*.

As far as the body 512 is concerned, the mandrel and piston are a single unit, and it can be seen that the circumference of the seal 34 in the body 512 is much larger than the circumference of the seal 548*b*. Consequently, hydraulic pressure of the mud in the tool 510 results in a larger downward force acting at the end 533 of the mandrel 518, via the seal sleeve 34, than acting in the reverse direction through the seal 548*b*.

The spring 44 acts between a shoulder 542 in the body 512 and the mandrel 518, urging the mandrel in the upstream direction. Should the pressure differential be such that the force acting on the mandrel exceeds the return force of the spring 44, the mandrel will move rightwardly in the drawing.

Likewise, hydraulic pressure acting on the control piston 536 across the circumference of its seals 46,548*a* to the mandrel result in a downward force on the piston 536 because the circumference of the seal 548*a* is smaller than seal circumference 46. Again, spring 50 (not shown) acts between shoulder 552 in the mandrel 518 and shoulder 554 on the piston 536 to urge the piston in an upstream direction. Again, should the hydraulic pressure be such that the force of the spring 50 is overcome, the piston 536 will move rightwardly in the drawings.

Figure 13:
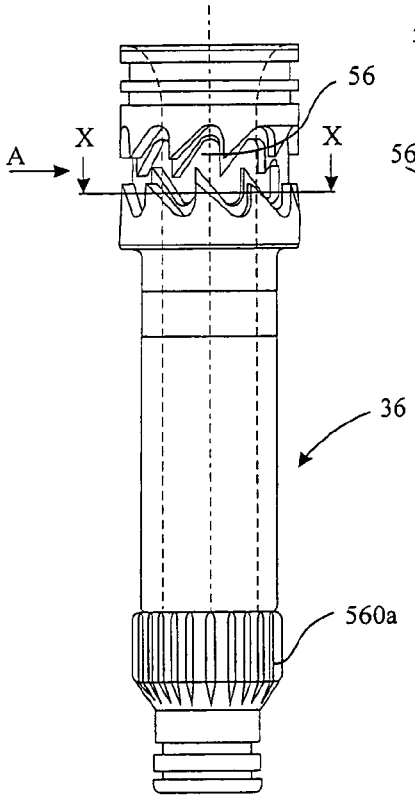
FIG. 13 is a side view of a control piston of the tool of FIG. 11.

The piston has same barrel cam 56 defined in its surface (see also FIG. 13) as described above and this functions in the same way. No further description of this arrangement is therefore necessary. However, as also shown in FIG. 13, the piston 536 has a splined section 560*a* which is engaged with a plurality of gears 61 disposed in pockets formed in the mandrel 518. The gears 61 are journalled for rotation in the mandrel pockets about axes 63 that are parallel the length of the stabiliser 510. The gears 61 mesh with a splined rack 564*a* disposed internally of the castellated sleeve 566. Consequently, since the mandrel is held rotationally fixed by stud 20 engaged with slot 22, when the piston rotates through the phase angle $2\alpha$ (on one complete return stroke thereof), the sleeve likewise rotates relative to the mandrel about the same angle $2\alpha$, albeit in the opposite direction.

The sleeve 566 is received between a shoulder 68 of the body 512 (in fact, on an end of compensation collar 525) and shoulder 69 of the mandrel 518. The sleeve is axially fixed on the mandrel 518 by a retention ring 67, but it is freely rotatable on the mandrel. The shoulder 68 is castellated having fingers and slots (not shown. The end 569 of the sleeve 66 is likewise castellated having fingers and slots (also not shown). These operate in the same way as described above with reference to FIGS. 5*a* and (possibly) 6. Further description is therefore not necessary.

Returning to FIG. 11*b*, the body has on the collar 525 a series of pockets 590 in each of which a plunger 592 is disposed. Springs 94 press the plunger radially outwards, the plungers being retained in the pockets 590 by threaded retainers(not shown). The plunger 592 is adapted to be received within a circumferential groove 500 in the mandrel 518. It is therefore apparent that rightward movement of the mandrel in the body 512 is only possible if the plungers 592 are first pressed radially inwardly and released from the groove 500. For this purpose groove 500 is provided with an angled cam surface 502. Thus when the mandrel is pressed sufficiently strongly in the rightward direction in the drawings, the returning force of the springs 94 may be overcome and the plungers 592 are pressed radially inwardly so that they pass over the lip of the groove 100.

In operation, the stabiliser 510 operates in the same way as described above.

Figure 12:
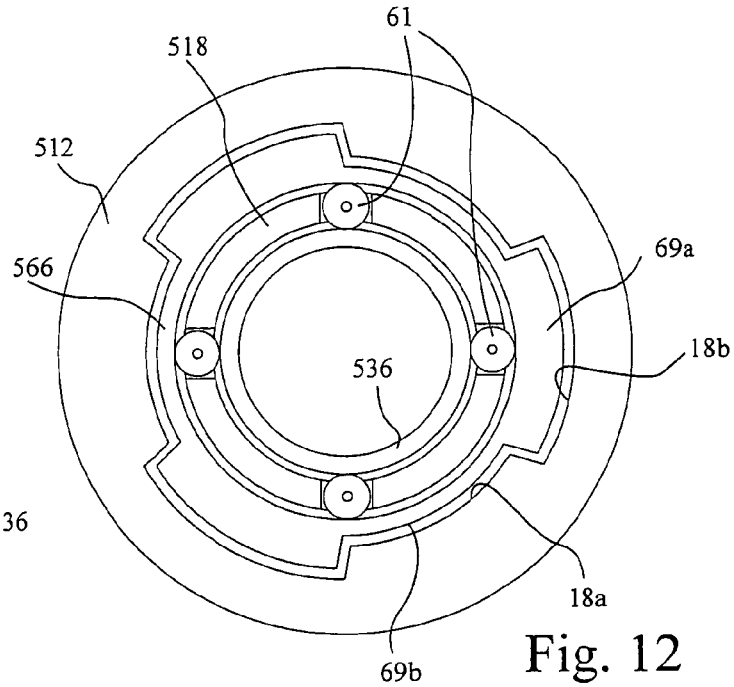
FIG. 12 is a section on the line XII—XII in FIG. 11*b;*
Figure 14:
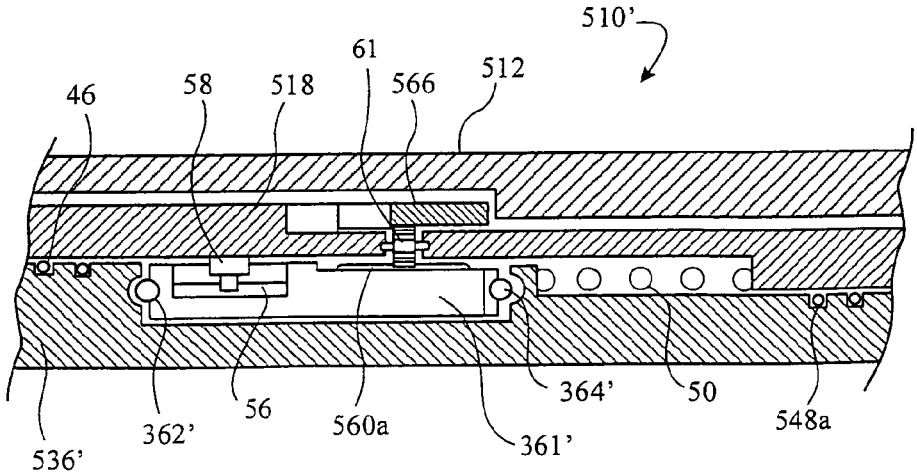
FIG. 14 is a partial side section of a variation of the embodiment shown in FIGS. 11*a, b* and *c.*

FIG. 12 shows the tool in section and illustrates the gears 61, of which four are shown. Also, only three fingers/slots 69*a*,18*a*/69*b*,18*b* are disposed around the body 512 and sleeve 566. Incidentally, the racks 560*a* and 564*a* of the piston 536 and sleeve 566 respectively are, of course, much longer than the axial extent of the rotation transmitters (the gears 61). This is because they slide axially with respect to the gears 61, which are themselves fixed axially in the mandrel 518. Thus the mandrel and sleeve slide over one another, depending on whether the castellations are in phase or out of phase with one another, and the piston slides in the mandrel under fluid and spring pressure, rotating as it does so to turn the sleeve between said in-phase and out-of-phase positions.

Finally, FIG. 7 shows an arrangement in which stabiliser 510' has the barrel cam 56 and splines 560*a* of the piston 536' mounted on a separate component 361' carried by the piston 536'. The component 361' is similar to the component 361 referred to above in relation to FIGS. 9 and 10. The component 361' is mounted on the piston 536' between bearings 362',364' to axially fix the component with respect to the piston, but permit it to rotate freely. This has the effect of reducing the amount of work that the barrel cam arrangement 56,58 has to do to rotate the sleeve 566. It removes the necessity to rotate the whole piston, so removing the resistance of frictional force between the seals 46,548*a* and the mandrel 518, as well as other contacts between the piston and mandrel.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

What is claimed is:

1. An adjustable down-hole tool comprising:

a body having a through bore;

a mandrel axially movable and rotationally fixed in the body, the mandrel being movable by fluid pressure in the tool against the action of a first return spring between two positions, one being a first, deactivated position and another being a second, activated position;

a sleeve, said sleeve limiting movement of said mandrel between said positions;

at least two sets of castellations, one set on the sleeve and the other set on an edge of the mandrel or body facing the castellations on the sleeve so that, when the castellations are in phase, the mandrel is prevented from travelling from said first to second position and when they are out of phase they interdigitate and the mandrel is not prevented from travelling from said first to second position; and means to rotate the sleeve relative to the facing edge between said in-phase and out-of-phase positions; wherein said means comprises a control piston slidable relative to the mandrel and the body by fluid pressure in the tool against the action of a second return spring and in which said piston is axially slidable with respect to said sleeve and rotationally coupled therewith.

2. An adjustable down-hole tool comprising:

a body having a through bore;

a mandrel axially movable in the body, the mandrel being movable by fluid pressure in the tool against the action of a first return spring between two positions, one being a first, deactivated position and another being a second, activated position;

a shoulder on the body;

a sleeve, said sleeve being between the shoulder and the mandrel;

at least two sets of castellations, one set on one of said shoulder and mandrel and the other set on a facing edge or edges of the sleeve so that, when the castellations are in phase, the mandrel is prevented from travelling from said first to second position and when they are out of phase they interdigitate and the mandrel is not prevented from travelling from said first to second position; and means to rotate the sleeve relative to the mandrel between said in-phase and out-of-phase positions; wherein said means comprises a control piston slidable with respect to the mandrel and the body by fluid pressure in the tool against the action of a second return spring; and wherein one of said piston and mandrel is rotationally fixed with respect to the body.

3. An adjustable down-hole tool comprising:

a body having a through bore;

a mandrel having a through bore axially movable in the body, the mandrel being movable by fluid pressure in the tool against the action of a first return spring between two positions, one being a first, deactivated position and another being a second, activated position;

a sleeve between the body and mandrel limiting movement of said mandrel between said positions;

at least two sets of castellations, one set on the sleeve and the other set on a facing edge of the body or mandrel so that, when the castellations are in phase, the mandrel is prevented from travelling from said first to second position and, when they are out of phase, they interdigitate and the mandrel is not prevented from travelling from said first to second position; and a control piston to rotate the sleeve relative to said facing edge between said in-phase and out-of-phase positions, the piston being movable by fluid pressure in the tool against the action of a second return spring; wherein said control piston is slidable in the mandrel, the mandrel carrying rotation transmitters that are in contact with both the piston and sleeve, whereby rotation of the piston relative to the mandrel rotates the sleeve relative to the mandrel.

4. A tool as claimed in claim 3, in which said rotation transmitters are carried by the mandrel intermediate its ends.

5. A tool as claimed in claim 4, in which said rotation transmitters are between axially spaced seals of the piston against the bore of the mandrel.

6. A tool as claimed in claim 3, in which said rotation transmitters comprise a gear rotationally journalled in the mandrel about an axis parallel the throughbores, both the piston and sleeve having a rack engaged with the gear.

7. A tool as claimed in claim 6, in which a plurality of said gears are disposed around the circumference of the mandrel.

8. A tool as claimed in claim 3, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser.

9. A tool as claimed in claim 3, in which a circumferential barrel cam is defined in one of said piston and mandrel, a cam follower being disposed in the other of said piston and mandrel, the follower being within the barrel cam so that axial movement of the piston with respect to the mandrel results in corresponding rotation of the piston with respect to the mandrel.

10. A tool as claimed in claim 9, in which a separate component of the piston is rotationally freely, but axially fixedly, mounted in the piston, which component carries said barrel cam or follower, said separate component driving said rotation transmitters on rotation of said component in response to axial movement of the piston in said mandrel.

11. A tool as claimed in claim 9, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser, and in which the barrel cam is shaped so that movement of the piston in one axial stroke and return thereof results in relative rotation of the sleeve and said facing edge from a said in-phase position to a said out-of-phase position or vice versa.

12. A tool as claimed in claim 11, in which said castellations are angularly spaced by a phase angle and said stroke and return of the piston results in relative rotation of the sleeve and said facing edge by said phase angle.

13. A tool as claimed in any of claim 9, in which said follower is a pin that has a relatively thin diameter end, and said barrel cam comprises a wide groove to receive a large diameter section of the pin and a deeper, narrow groove within said wide groove to receive said thin end of the pin.

14. A tool as claimed in claim 3, in which one set of said castellations comprise an even number of alternating fingers and slots, and in which alternate fingers are longer than the remaining fingers, and the other set of castellations comprise the same number of alternating fingers and slots, and in which alternate slots are shorter than the remaining slots, whereby an intermediate position of the mandrel is defined when said longer fingers interdigitate with said shorter slots.

15. A tool as claimed in claim 3, in which, when said mandrel is in said deactivated position, a rise in hydraulic pressure in the tool results in movement of the piston before movement of the mandrel.

16. A tool as claimed in claim 3, in which said first return spring is sufficiently stronger than said second return spring to ensure that, when said mandrel is in said deactivated position, a rise in hydraulic pressure in the tool results in movement of the piston before movement of the mandrel.

17. A tool as claimed in claim 3, in which a spring loaded detent between said mandrel and body retains the mandrel in said deactivated position until a threshold hydraulic pressure has been exceeded, which pressure is greater than that required to move said piston.

18. A tool as claimed in claim 17, in which said detent comprises a plunger in a radial bore of the mandrel or body, spring biassed against a lip of the body or mandrel respectively.

19. A tool as claimed in claim 18, in which said lip is of a circumferential groove around the mandrel.

20. A tool as claimed in claim 17, comprising a plurality of said detents arranged around the circumference of the mandrel.

21. A tool as claimed in claim 3, in which the mandrel is sealed to the body about first and second circumferences, the first being a larger circumference upstream, in terms of fluid flow through the tool, of the second, smaller circumference.

22. A tool as claimed in claim 3, in which the piston has a through bore and is sealed to the mandrel about third and fourth circumferences, the third being a larger circumference upstream, in terms of fluid flow through the tool, of the fourth, smaller circumference.

* * * * *